US005713550A

United States Patent [19]

Schwarzli

[11] Patent Number: 5,713,550

[45] Date of Patent: Feb. 3, 1998

[54] MODULAR PEDESTAL FOR VENDING MACHINES

[75] Inventor: Josef W. Schwarzli, Stouffville, Canada

[73] Assignee: Machine-O-Matic Limited, Newmarket, Canada

[21] Appl. No.: 677,723

[22] Filed: Jul. 8, 1996

[30] Foreign Application Priority Data

Apr. 29, 1996 [CA] Canada ..... 2175281

[51] Int. Cl.[6] ..... A47B 91/00

[52] U.S. Cl. ..... 248/346.02; 403/293; 403/388; 248/678

[58] Field of Search ..... 248/346.02, 346.03, 248/346.01, 678, 676, 907; 403/DIG. 3, 388, 293, 554, 217; 211/189, 175

[56] References Cited

U.S. PATENT DOCUMENTS

| | | | |
|---|---|---|---|
| 5,180,134 | 1/1993 | Mallak | 248/346.03 X |
| 5,524,860 | 6/1996 | Ives | 248/674 |
| 5,542,642 | 8/1996 | Rivard | 248/678 X |

FOREIGN PATENT DOCUMENTS

| | | | |
|---|---|---|---|
| 6705535 | 12/1967 | Switzerland | 256/24 |

*Primary Examiner*—Ramon O. Ramirez

[57] ABSTRACT

The invention provides a modular pedestal for a bank of vending machines, comprising a plurality of pedestal modules onto which each vending machine is mounted. Each pedestal module has a plurality of connecting posts disposed adjacent to edges of the top face at selected positions, so that when pedestal modules are placed side-by-side at least one post on the pedestal module is adjacent to at least one post on an adjacent pedestal module. A connecting member, having a plurality of openings spaced apart a distance approximating the spacing between adjacent posts of the adjacent pedestal modules, is placed over the adjacent connecting posts to connect the modules together, and retained in position by the base of the vending machine. In a preferred embodiment the sides of the pedestal modules converge slightly toward the top and the openings in the connecting elements are slightly larger than the posts, allowing adjacent pedestal modules to shift relative to one another and thus to accommodate an uneven floor surface.

20 Claims, 9 Drawing Sheets

MODULAR PEDESTAL FOR VENDING MACHINES

FIELD OF INVENTION

This invention relates to vending machines. In particular, this invention relates to a modular pedestal system for bulk vendors, which allows a plurality of bulk vendors to be connected in a variety of different configurations to form a bank of bulk vendors having a desired size and appearance.

BACKGROUND OF THE INVENTION

Bulk vendors, often colloquially known as "gumball machines", are popular in high traffic areas of shopping mails, restaurants, movie theatres and the like, primarily because of their ability to consistently dispense a preset amount of confectionary or other merchandise while requiring very little attention and maintenance. A typical bulk vendor consists of a housing containing a coin mechanism and collection tray disposed beneath a transparent product bin, so that when the required coinage is inserted into the coin mechanism and the handle is rotated, one or more articles are dispensed from the product bin through a chute located in the housing and accessible to the patron.

Typically the product bin is filled with a single type of product, be it gumballs or other types of confectionary, small toys, etc., since in a conventional bulk vendor the dispensing mechanism must be preset to the size and number of articles to be dispensed. Thus, where it is desirable to provide a broader selection of merchandise to patrons, a number of bulk vendors are provided in a bank, and each vendor can be stocked with a different type of merchandise. As such bulk vendors are now frequently sold in banks consisting of a plurality of individual bulk vendors connected together in a particular configuration. This includes configurations for placement against a wall, in which case all of the vendors will face the same direction, or a so called "island" which is a free-standing bank of bulk vendors designed to be located centrally in an open area and in which the vendors may face all four directions so as to be accessible from all sides.

A typical bank of bulk vendors is supported on a stand, raised from the floor so that the coin mechanisms and dispensing chutes are within easy reach of patrons. The most important disadvantage to such a system is that the stand must be designed to accommodate exactly the intended number of bulk vendors, and in a specific predetermined configuration. This considerably limits the versatility of the bulk vendor bank, in that in order to add remove vendors or reconfigure the bank a new stand would be required, and the ability to reposition or relocate the bank is limited by the preset configuration of the stand.

This system has also given rise to cleaning problems, in that certain regions around the legs of the stand are difficult to access, so dirt, wax and cleaner residues tend to build up in these areas to an unsightly degree, and to potential safety problems because children tend to play underneath the bank, where there can be sharp metal edges and corners. Thus, from aesthetic and safety standpoints it is advantageous to provide the bank with an enclosed stand or base, to avoid these problems. At the same time, it is advantageous to provide each vendor with its own individual pedestal or stand, so that vendors can be added, removed or repositioned as desired without having to change to an entirely new stand. However, the individual stands should also be capable of being interconnected, to increase the integrity and stability of the bank of vendors.

The present invention overcomes these disadvantages by providing a modular pedestal system which acts as a pedestal or stand supporting a bank of bulk vendors, comprising individual pedestal modules that connect the vendors together into an integral bank of a desired configuration, incorporating any number of bulk vendors. The invention thus results in a unitary structure which is stable and attractive in appearance, and which completely conceals the floor underneath the bank of vendors. Vendors can be added, removed or repositioned as desired, without requiring the disassembly of the entire bank or replacement of the entire stand, and using a minimum number of parts, which both facilitates changing the bank and reduces the number of parts required to be purchased or kept in inventory by an operator.

The invention accomplishes this by providing a pedestal module having connecting posts disposed at selected positions around its periphery, preferably at the corners and near the midpoint of at least one side, and connecting members having openings for engaging the posts. The connecting members are engaged over the posts of adjoining pedestal modules, and the base of each bulk vendor seats over the connecting posts after the connecting members have been positioned, so that the vendor base itself serves to retain the connecting members in position. Thus, a wide variety of vendor bank configurations is available using only two parts—the pedestal modules and the connecting members—and vendors can be added, removed or repositioned as desired simply by detaching adjacent vendors from their supporting pedestal modules and removing (or adding) one or more connecting members. The connecting posts at the corners of the pedestal module also facilitate storage and shipping, by providing a means for stacking the pedestal modules.

Furthermore, because the connecting members are not positively locked to the posts, making the openings in the connecting member slightly larger than the connecting posts allows the connecting member to slide slightly laterally relative to the pedestal module. In the preferred embodiment the pedestal module is provided with inclined side faces, which allows the pedestal module to shift relative to adjacent pedestal modules. This permits the modular pedestal to accommodate an uneven floor surface and thus ensures that each pedestal module bears the weight of the bulk vendor which it supports.

SUMMARY OF THE INVENTION

The present invention thus provides a modular pedestal for a vending machine, comprising a plurality of pedestal modules each having a top face onto which the vending machine is mounted and a plurality of connecting posts disposed adjacent to edges of the top face at selected positions, such that at least one post on one pedestal module is adjacent to at least one post on an adjacent pedestal module, and at least one connecting member having a plurality of openings, at least two openings being spaced apart a distance approximating a spacing between the adjacent posts of the adjacent pedestal modules, whereby openings in the connecting member can simultaneously engage adjacent connecting posts of adjacent pedestal modules.

The present invention further provides a pedestal module for a pedestal for a vending machine, comprising a top face onto which the vending machine is mounted, and a plurality of connecting posts disposed adjacent to edges of the top face at selected positions, wherein a connecting member having a plurality of openings can simultaneously engage adjacent connecting posts of two adjacent pedestal modules.

The present invention further provides, in combination, a bank of connected vending machines comprising, in combination, a modular pedestal, comprising a plurality of pedestal modules each having a top face onto which the vending machine is mounted and a plurality of connecting posts disposed adjacent to edges of the top face at selected positions, such that at least one post on one pedestal module is adjacent to at least one post on an adjacent pedestal module; at least one connecting member having a plurality of openings, at least two openings being spaced apart a distance approximating a spacing between the adjacent posts of the adjacent pedestal modules, whereby openings in the connecting member can simultaneously engage adjacent connecting posts of adjacent pedestal modules; and a plurality of vending machines each having a base for engaging over the connecting members.

BRIEF DESCRIPTION OF THE DRAWINGS

In drawings which illustrate by way of example only a preferred embodiment of the invention.

DETAILED DESCRIPTION OF THE INVENTION

Figure 1:
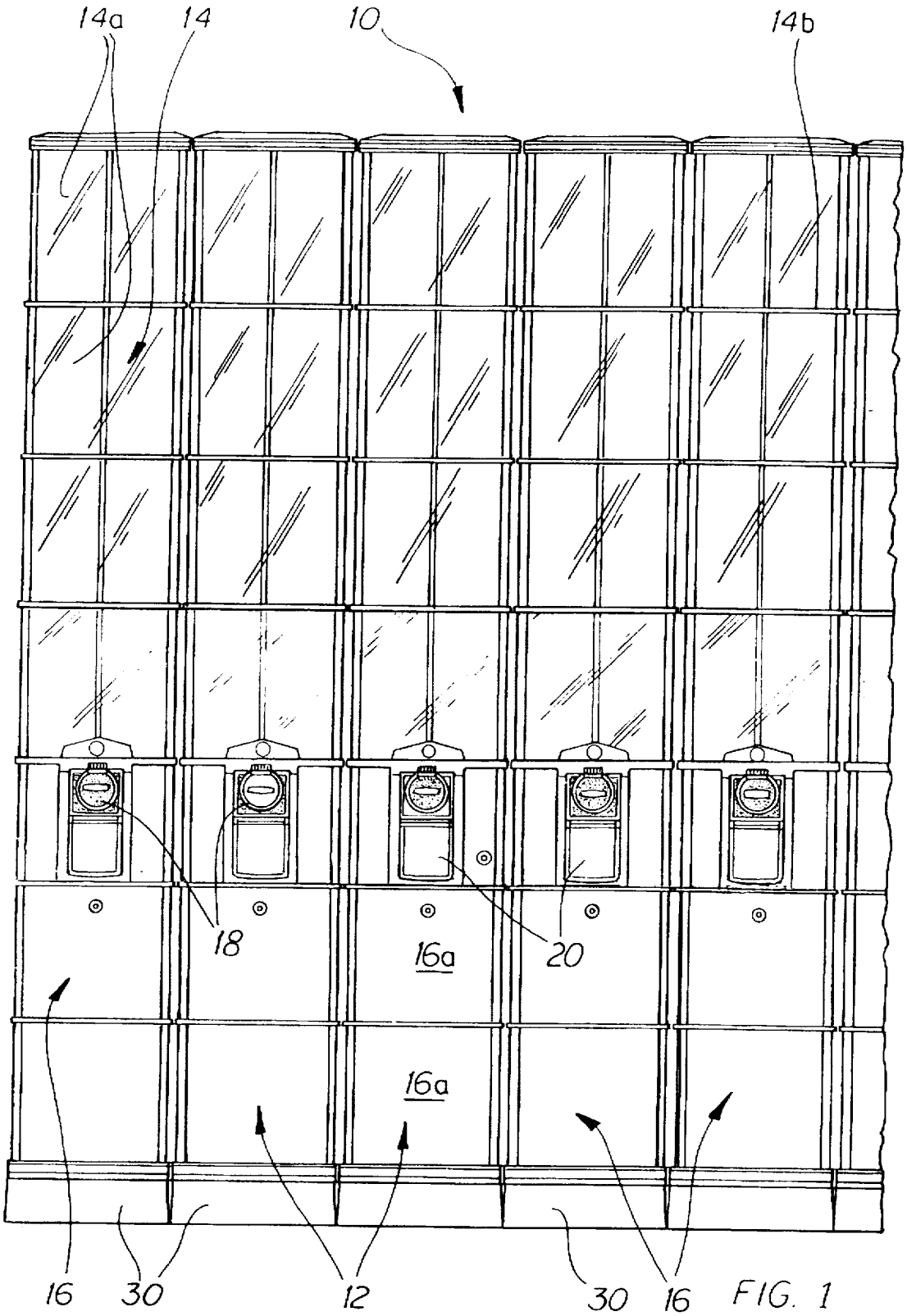
FIG. 1 is a partial front elevation of a bank of bulk vendors embodying the invention.

FIG. 1 illustrates a bank 10 of vending machines or so-called "bulk vendors" 12 supported on a pedestal according to the invention. Each vending machine 12 comprises a transparent product bin 14 composed of a plurality of enclosed sections **14*a* in a tiered formation, and a base 16 providing a coin mechanism 18 and a dispensing chute 20 and containing means for collecting coins (not shown) deposited by patrons. In the embodiment illustrated each base 16 is formed from enclosed opaque sections 16*a* arranged in a tiered formation and supports the product bins 14** in the configuration of a column or tower.

Figure 2:
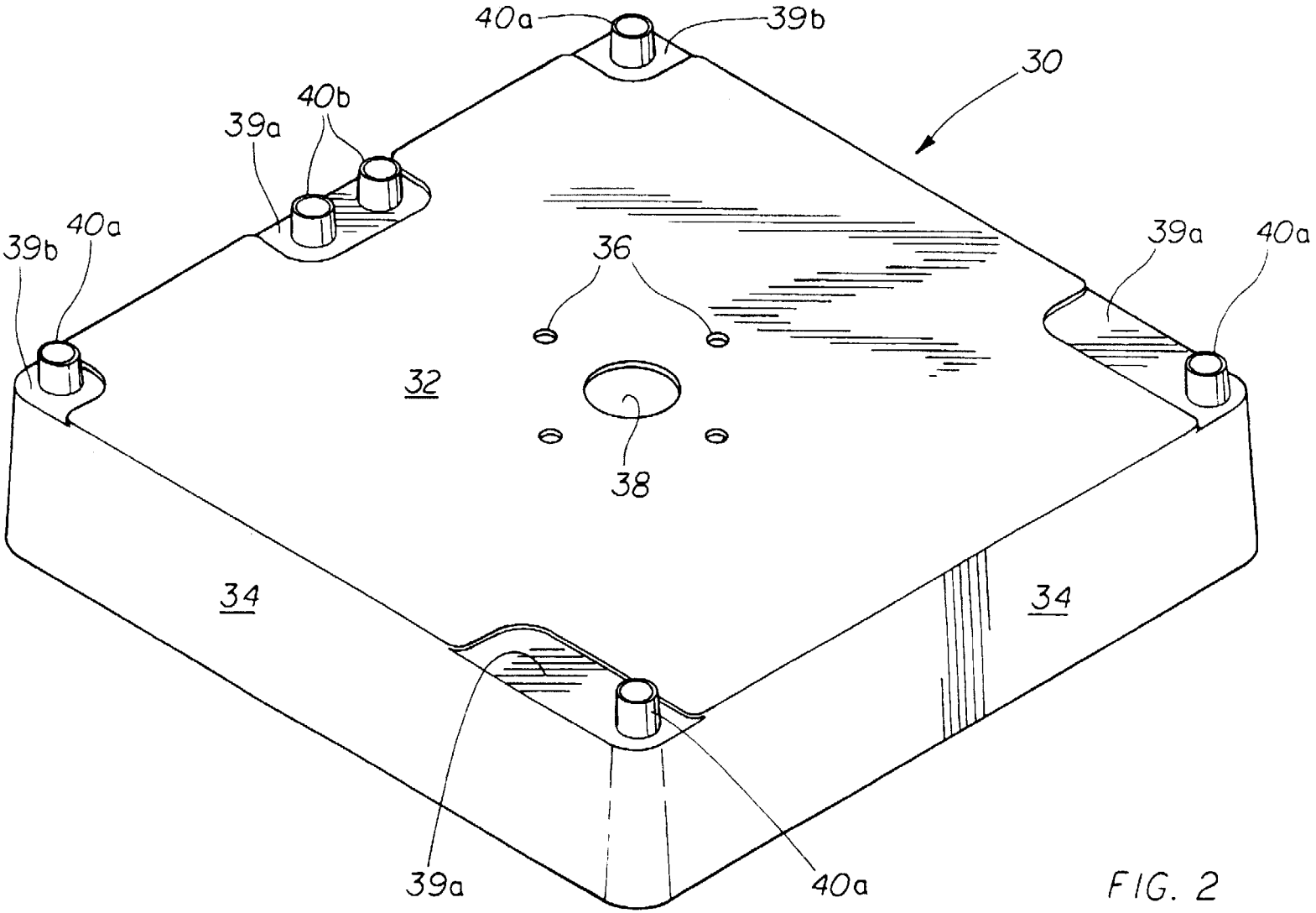
FIG. 2 is a perspective view of a pedestal module.

Each vending machine 12 is provided with a pedestal module 30, shown in FIG. 2, formed from any suitable material such as metal, plastic or wood, for forming a modular pedestal which raises the vendors 12 above the floor surface and provides a means for interconnecting the vendors 12 in the bank 10.

The pedestal module 30 comprises a top face 32 and sides 34 which preferably converge upwardly toward the top face 32, for reasons which will be described below. The top face 32 is provided with means for securing a mounting plate 22, shown in FIG. 3, such as openings 36 for bolts 24. Preferably the pedestal module 30 is square and is provided with four openings 36, allowing the mounting bracket 22 to be mounted facing any of the sides 34, which in turn allows the front of the vending machine 12 to mount flush with any side 34 of the pedestal module 30 for maximum versatility. A central opening 38 is also provided, allowing clearance for a threaded locking nipple 28 (shown in FIG. 3) which is engaged through the threaded receptacle 23 in the mounting plate 22 (from inside the base 16) and thus locks the vending machine base 16 to the pedestal module 30.

Figure 7:
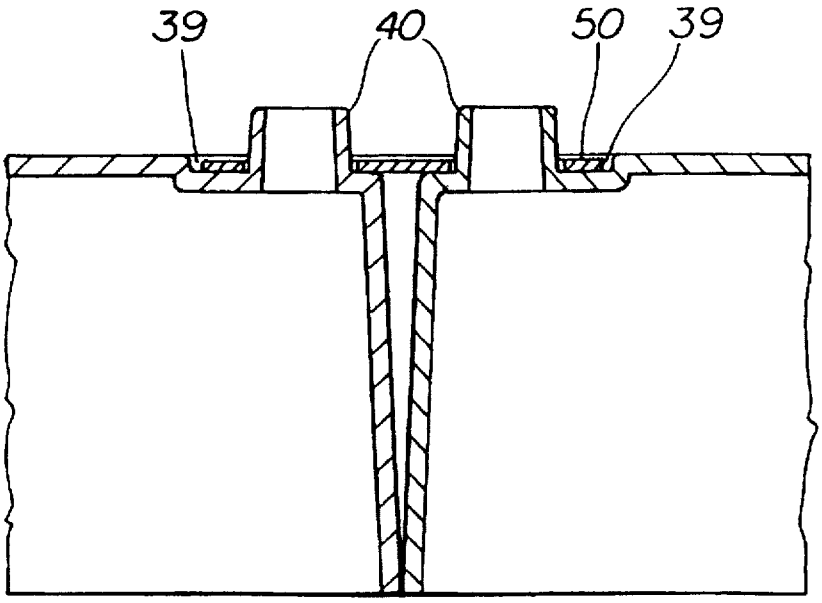
FIG. 7 is a cross section taken along the line 7—7 in FIG. 6.

A plurality of preferably generally cylindrical connecting posts 40 are provided adjacent to edges of the top face 32, preferably one connecting post **40*a* at each corner and a pair of connecting posts 40*b* positioned symmetrically about approximately the midpoint of at least one edge. It is possible to provide a pair of connecting posts 40 at positioned adjacent to the midpoint of each edge, but because the vending machine 12 can be mounted on the pedestal module 30 facing any side 34 this should generally be unnecessary. The connecting posts 40, seen in cross section in FIG. 7, are preferably cast or molded integrally with the pedestal module 30, and preferably taper slightly toward the top of the post 40**.

Figure 6:
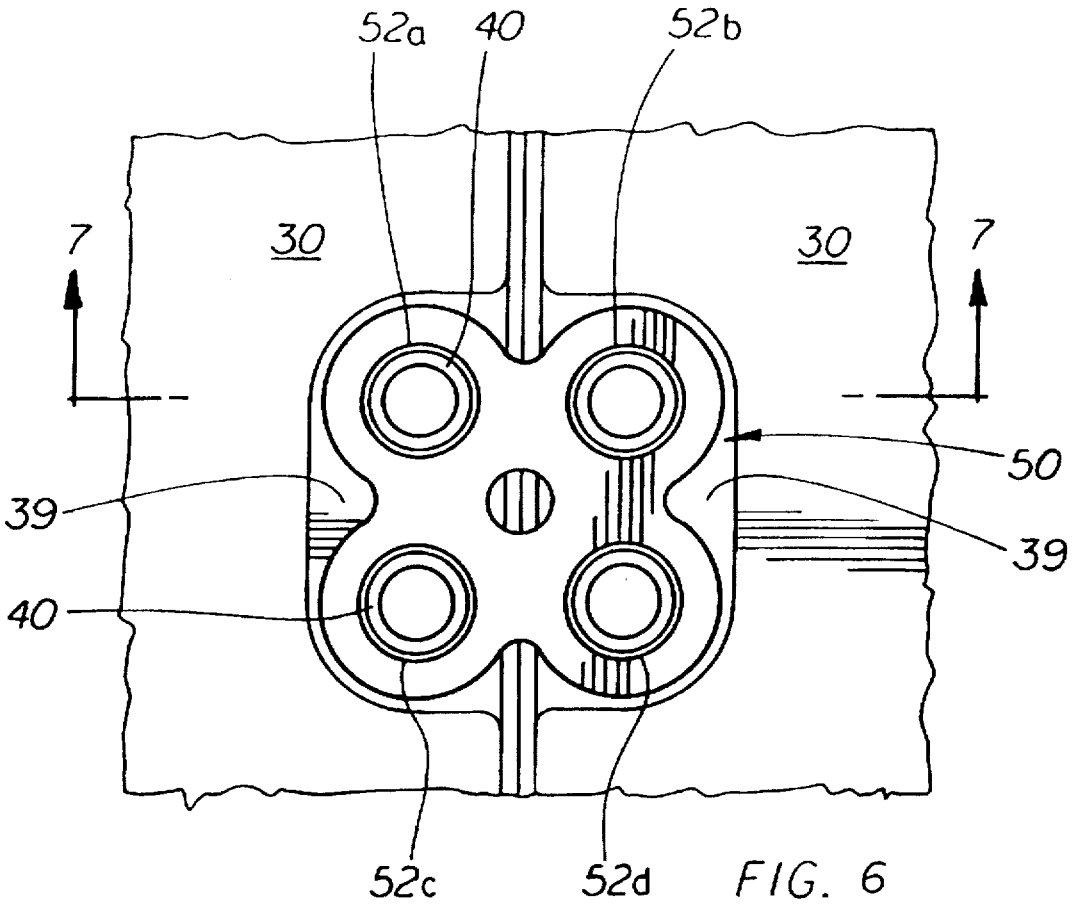
FIG. 6 is a top plan view showing the connecting element.

A connecting member 50 is provided with a plurality of openings 52 complimentary to the connecting posts 40 and slightly larger in diameter than the bottom of each post 40, as best seen in FIG. 6. The connecting member 50 may be made of metal, plastic or any other suitably strong and rigid material, and is preferably provided with four openings 52 distributed symmetrically about its centre. The spacing between adjacent openings (**52*a* and 52*b*; 52*a* and 52*c*; 52*b* and 52*d*; and 52*c* and 52*d*) approximates the spacing between adjacent posts 40 when two pedestal modules 30 are placed side-by-side, as illustrated in FIGS. 6 and 7. In this fashion the connecting member 50 can be placed over adjacent posts 40 of adjacent pedestal modules 30 to connect the adjacent pedestal modules 30 together. The spacing between the posts 40*b* is the same as the spacing between adjacent posts 40 when two pedestal modules 30 are placed side-by-side, so that the connecting members 50 can be symmetrical and their orientation when engaged over the posts 40** is irrelevant.

Figure 8:
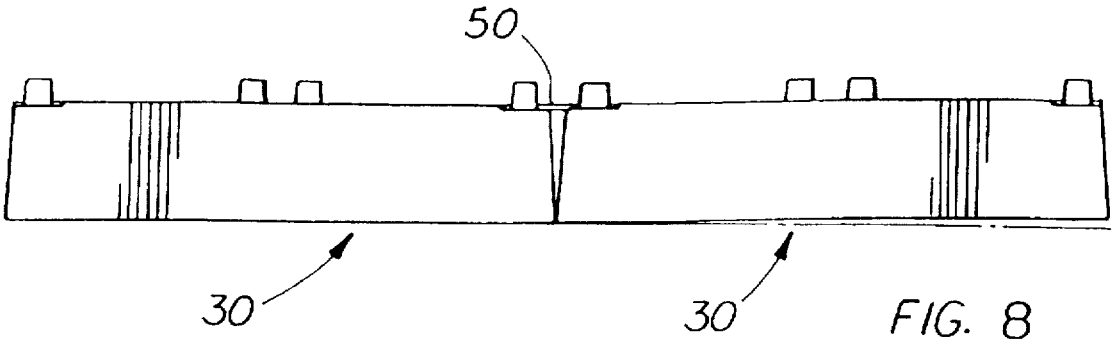
FIG. 8 is a side elevation showing the pedestal on an uneven surface.

Because the openings 52 are slightly larger in diameter than the posts 40, there is some lateral "play" which allows the adjacent pedestal modules 30 to shift slightly relative to one another. The sides 34 of the pedestal modules 30 are therefore preferably inclined from the vertical, converging slightly toward the top face 32, so that adjacent pedestal modules 30 can assume slightly different attitudes to accommodate uneven floor surfaces, as shown in FIG. 8.

Figure 4:
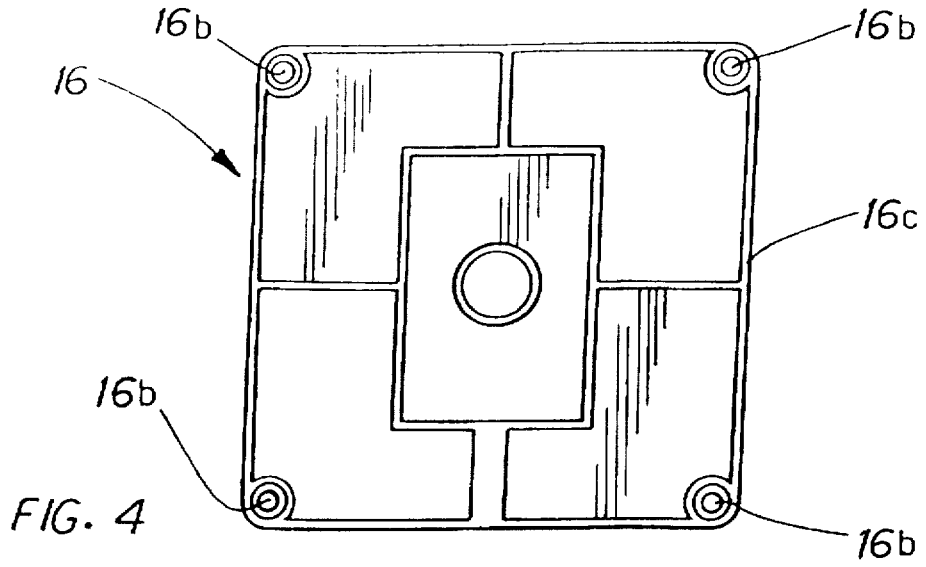
FIG. 4 is a bottom plan view of the bulk vendor base, arranged in the configuration of an island.
Figure 5:
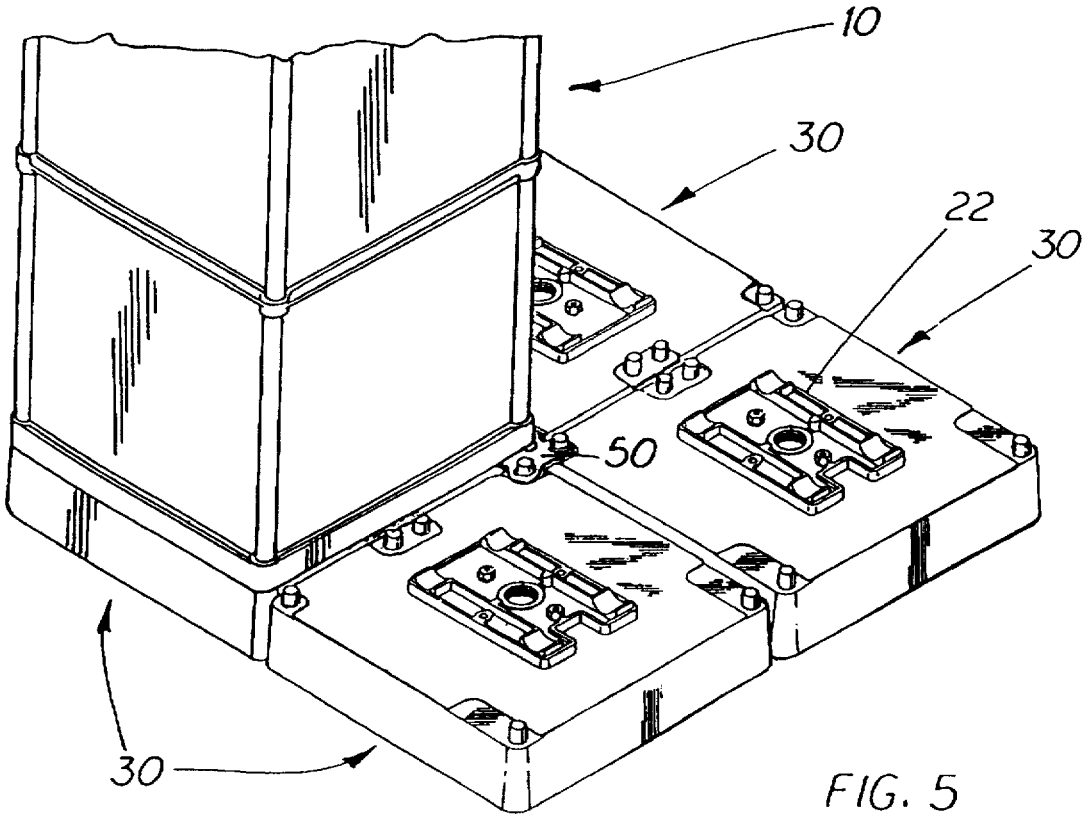
FIG. 5 is a perspective view of a plurality of pedestal modules arranged in the configuration of an island.

The bottom of the base 16 of the vending machine 12 is provided with a projecting lower lip **16*c* sits on the top face 32 of the pedestal module 30. The posts 40 are set in from the edges of the top face 32 sufficiently to accommodate the lip 16*c*. The bottom of the base 16 may also be provided with receptacles 16*b* at the corners, as seen in FIG. 4, for engaging over the corner connecting posts 40*a* for a more secure fit. Thus, once the connecting member 50 has been engaged over the adjacent posts 40, mounting the base 16** onto the pedestal module 30 serves to retain the connecting member 50 in position, as can be seen in FIG. 5. To ensure that the base 16 seats properly on the top face 32, recesses 39 which are slightly deeper than the thickness of the connecting members 50 are disposed about each of the connecting posts 40, as shown in FIGS. 6 and 7, so that when the connecting member 50 is seated in the recess 39 the lip 16*c* can mount flush to the top face 32 of the pedestal module 30.

In the preferred embodiment illustrated some recesses 39*a* are wide enough to accommodate one half of a connecting member 50, while some recesses 39*b* are wide enough to accommodate only one quarter of a connecting member 50. This is simply to facilitate construction of the pedestal by reducing the permutations and combinations available to personnel erecting the bank 10 and to thus decrease the likelihood of improper positioning of adjacent pedestal modules 30. Several possible configurations of the pedestal with pedestal modules 30 connected to form an island are illustrated schematically in FIGS. 14, 14*a*, 14*b* and 14*c*, there being many other configurations available. Each pedestal module 30 can also be used as a stand or pedestal for a single vending machine 12.

Figure 3:
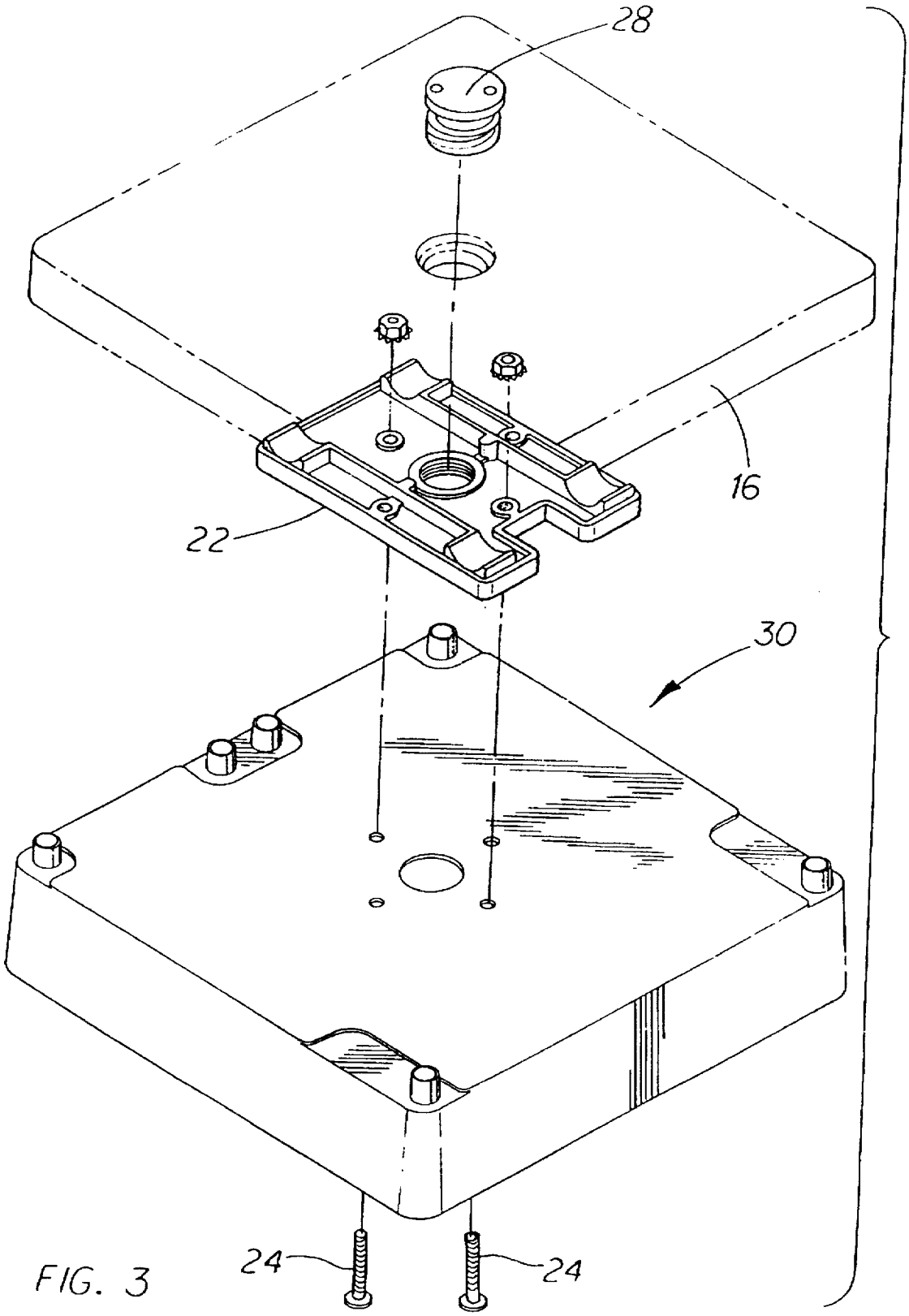
FIG. 3 is an exploded perspective view of the pedestal module showing the manner of mounting the bulk vendor.

The bank 10 of vending machines 12 is constructed by attaching a mounting plate 22 to each pedestal module 30, as shown in FIG. 3, and placing the pedestal modules 30 side-by-side in the configuration and orientation desired for the bank 10. Connecting members 50 are engaged over the connecting posts 40 of adjacent modules, as shown in FIG. 5. The vending machines 12 are then mounted onto each pedestal module 30 and their bases 16 are locked to the mounting plates 22. To add or remove vending machines 12, all immediately adjacent vendors 12 are detached and removed and pedestal modules 30 are added or removed as required, with the attendant addition or removal of connecting elements 50.

Figure 11:
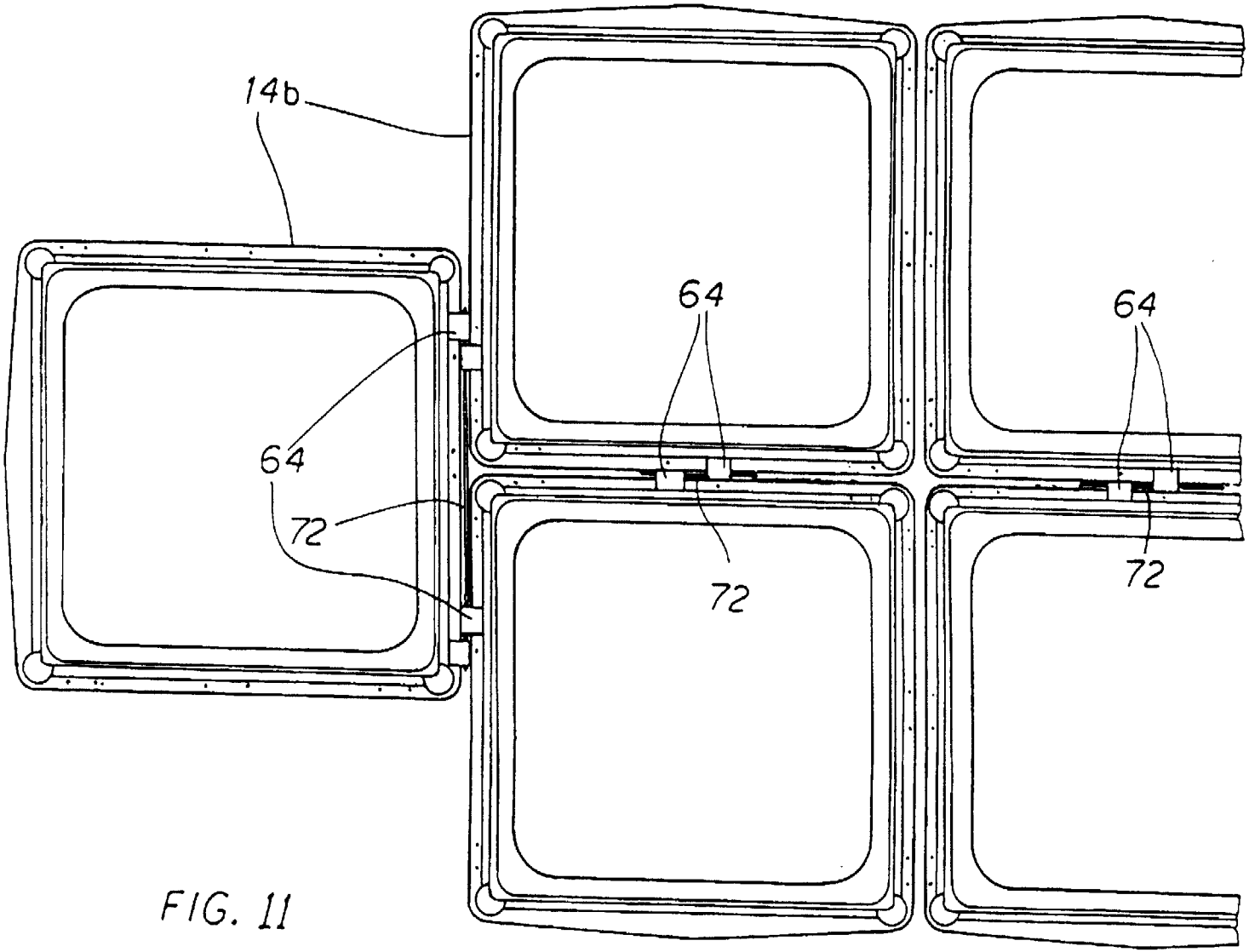
FIG. 11 is a top plan view showing the preferred manner of connecting the product bins of adjacent bulk vendors.
Figure 12:
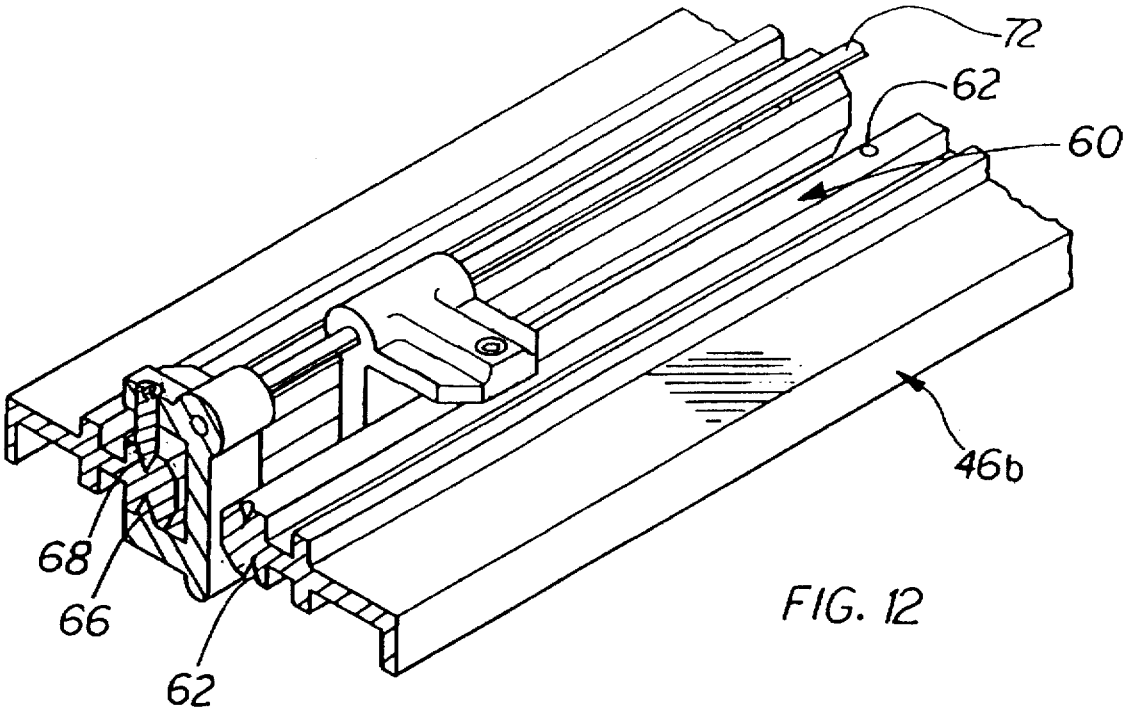
FIG. 12 is a cross sectional perspective view showing the connecting elements of FIG. 11.
Figure 13:
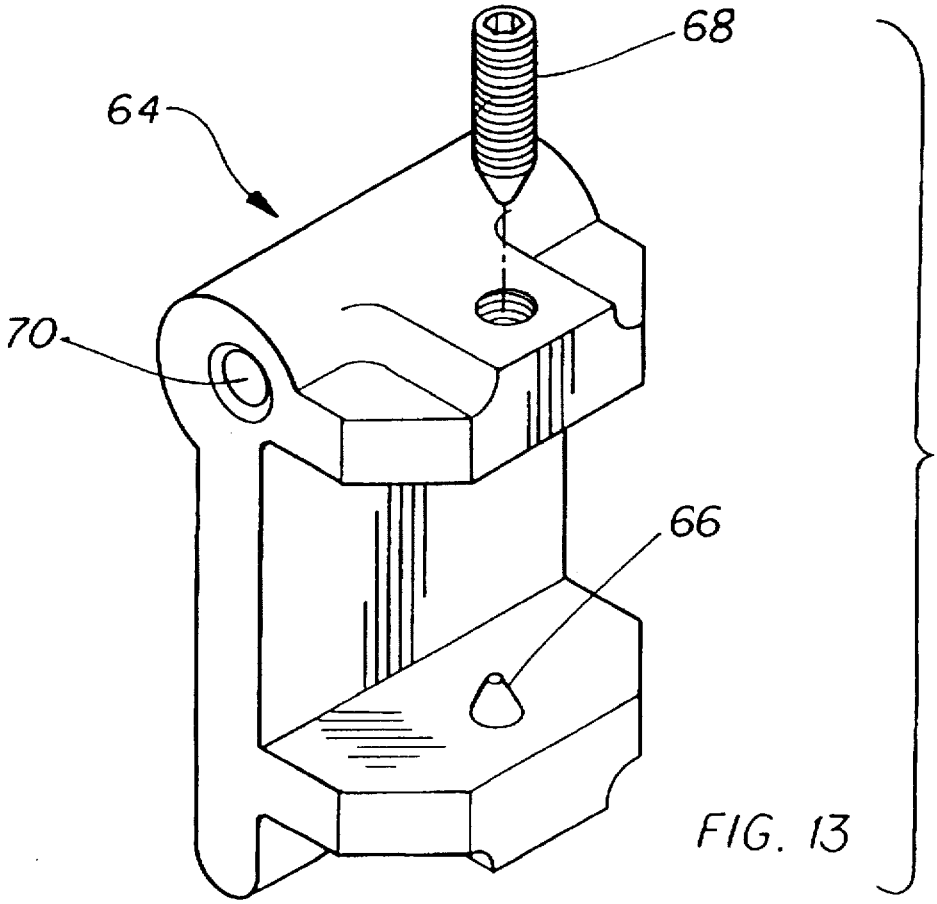
FIG. 13 is an exploded perspective view showing the connecting elements of FIG. 11, and FIGS. 14, 14*a*, 14*b* and 14*c* are schematic views illustrating some possible configurations of pedestals constructed according to the invention.
Figure 14:
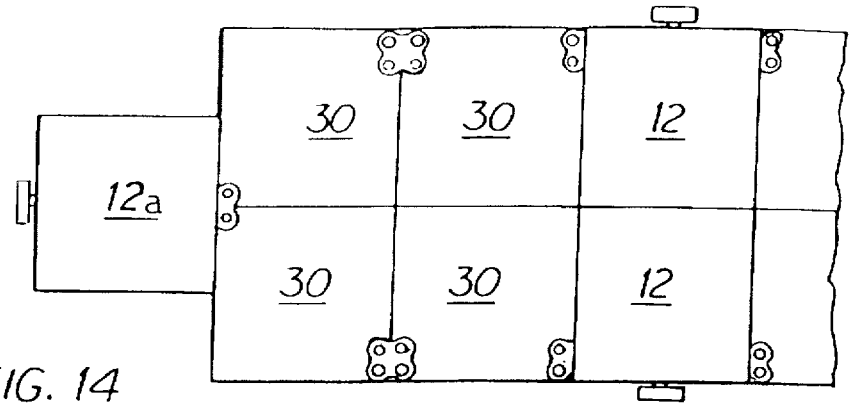
Figure 14A:
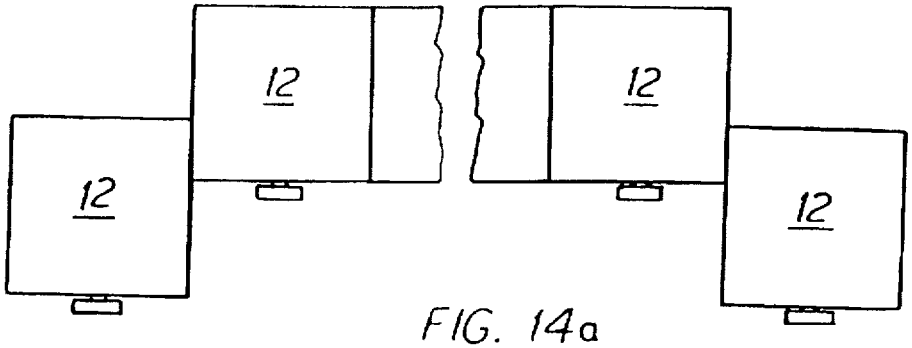
Figure 14B:
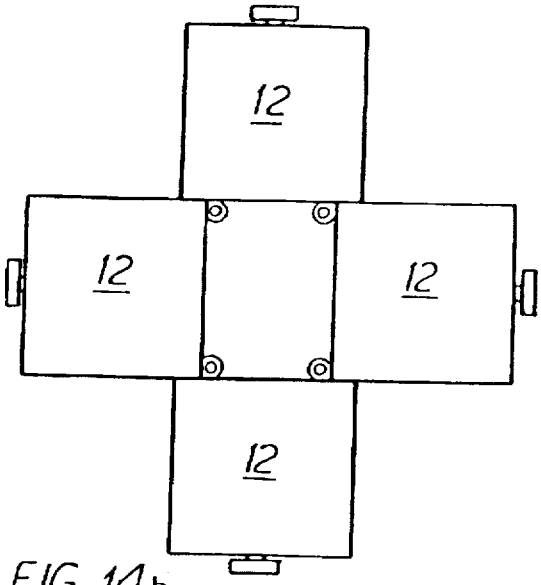
Figure 14C:
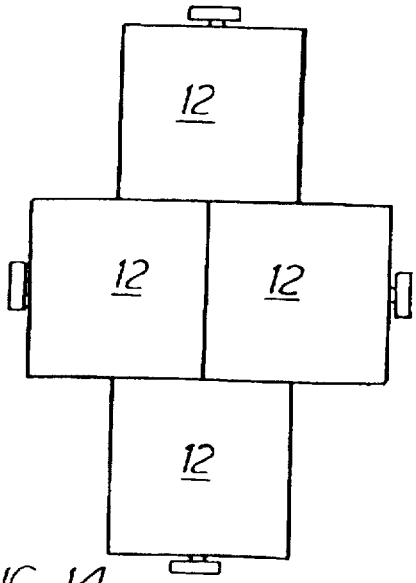

Once the bank 10 of vending machines 12 has been erected, particularly in the configuration of a free-standing island, the product bins 14 should be secured together to improve the stability and integrity of the bank 10. At one tier (shown by way of example as the second from the top in FIG. 1) the frame members 14*b* of each vending machine 12 are provided with a lip 60 having upper and lower cavities 62, as seen in FIG. 12. One or more clamps 64, illustrated in FIG. 13, are affixed to each frame member 14*b* by inserting the boss 66 into a lower cavity 62 and driving the screw 68 into the corresponding upper cavity 62. The clamps are each provided with a bore 70, and as each back-to-back pair of vending machines 12 is erected a wire 72 is inserted through the aligned bores 70 to tie the adjacent product bins 14 together, as illustrated in FIG. 11. The wire 72 is slightly shorter than the width of the vending machine 12, and the ends of the wire 72 are bent or crimped to resist detachment from the clamps 64.

The end vending machines 12*a* are then mounted at the ends of the bank 10, and a wire 72 can be inserted through the bores 70 to tie their product bins 14 to the rest of the island or, if desired for tamper-resistance, the clamps 64 for attaching the end machines 12*a* can be cast with a threaded bores 70 for bolts (not shown) to be inserted through the bores 70 to connect the clamps 64 at the back of the end machine 12 to clamps 64 at the sides of adjacent vending machines 12.

Figure 9:
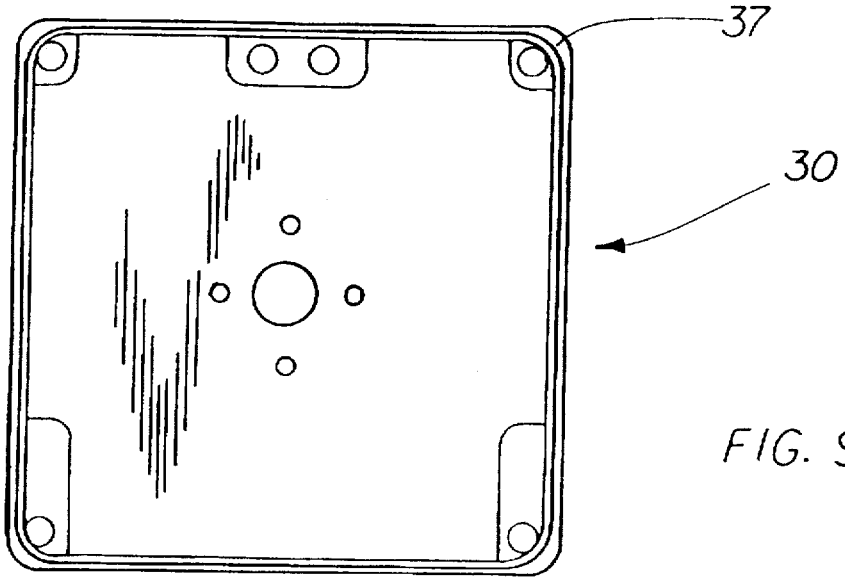
FIG. 9 is a partially cutaway bottom plan view of the pedestal module.
Figure 10:
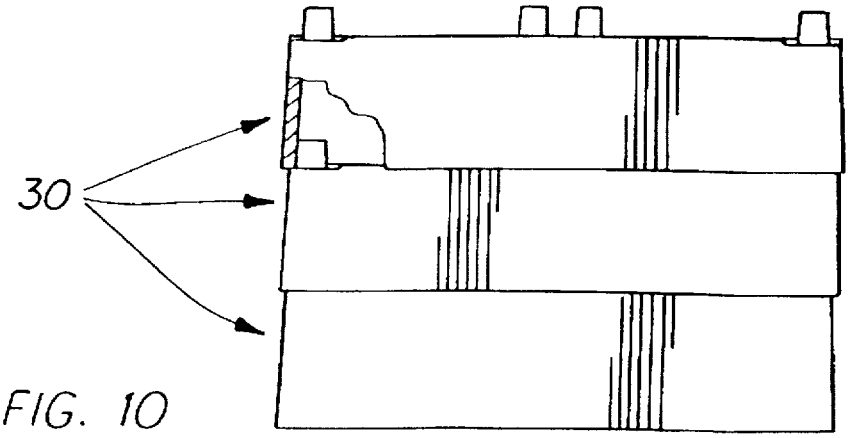
FIG. 10 is a front elevation showing the manner of stacking the pedestal motives.

To facilitate storage and shipping, the interior corners of each pedestal module 30 are thickened slightly, as shown in bottom plan view in FIG. 9, so that the pedestal modules 30 can be stacked securely with the connecting posts 40 of one pedestal module 30 abutting the inside corners of the next higher pedestal module 30, as shown in FIG. 10.

A preferred embodiment of the invention having been thus described by way of example only, it will be apparent to those skilled in the art that certain modifications and adaptations may be made without departing from the scope of the invention, as set out in the appended claims.

I claim:

1. A modular pedestal adapted for use with a vending machine, comprising a plurality of pedestal modules each having a top face onto which the vending machine is mounted and a plurality of connecting posts disposed adjacent to edges of the top face at selected positions, such that at least one post on one pedestal module is adjacent to at least one post on an adjacent pedestal module, and at least one connecting member having a plurality of openings, at least two openings being spaced apart a distance approximating a spacing between the adjacent posts of the adjacent pedestal modules, whereby openings in the connecting member can simultaneously engage adjacent connecting posts of adjacent pedestal modules and abutting sides of adjacent pedestal modules converge inwardly toward the top face.

2. The modular pedestal of claim 1 in which connecting posts are provided adjacent to corners of the pedestal module.

3. The modular pedestal of claim 2 in which connecting posts are provided adjacent to an edge of the top face of the pedestal module at substantially a middle point thereof.

4. The modular pedestal of claim 1 in which the openings in the connecting member are larger than the posts.

5. The modular pedestal of claim 1 in which the connecting member is provided with four substantially symmetrical openings.

6. The modular pedestal of claim 1 in which the top face is provided with recesses surrounding the posts in which the connecting member can be seated.

7. The modular pedestal of claim 6 in which a base of the vending machine is provided with receptacles for engaging the posts.

8. The modular pedestal of claim 6 in which some recesses are dimensioned to receive approximately one half of a connecting member and other recesses are dimensioned to receive approximately one quarter of a connecting member.

9. The modular pedestal of claim 1 in which the pedestal module has an open bottom and means for abutting the posts when a pedestal module is mounted atop another pedestal module.

10. A modular pedestal adapted for use with a vending machine, comprising a plurality of pedestal modules each having a top face onto which the vending machine is mounted and a plurality of connecting posts disposed adjacent to edges of the top face at selected positions, such that at least one post on one pedestal module is adjacent to at least one post on an adjacent pedestal module, and at least one connecting member having a plurality of openings, at least two openings being spaced apart a distance approximating a spacing between the adjacent posts of the adjacent pedestal modules, wherein the top face is provided with recesses surrounding the posts in which the connecting member can be seated, whereby openings in the connecting member can simultaneously engage adjacent connecting posts of adjacent pedestal modules with the connecting member seated in the recess.

11. The modular pedestal of claim 10 in which connecting posts are provided adjacent to corners of the pedestal module.

12. The modular pedestal of claim 11 in which connecting posts are provided adjacent to an edge of the top face of the pedestal module at substantially a middle point thereof.

13. The modular pedestal of claim 10 in which the openings in the connecting member are larger than the posts.

14. The modular pedestal of claim 13 in which abutting sides of adjacent pedestal modules converge inwardly toward the top face.

15. The modular pedestal of claim 10 in which some recesses are dimensioned to receive approximately one half of a connecting member and other recesses are dimensioned to receive approximately one quarter of a connecting member.

16. The modular pedestal of claim 10 in which the pedestal module has an open bottom and means for abutting the posts when a pedestal module is mounted atop another pedestal module.

17. The modular pedestal of claim 10 in which the connecting member is provided with four substantially symmetrical openings.

18. A bank of connected vending machines comprising, in combination, a modular pedestal, comprising a plurality of pedestal modules each having a top face onto which the vending machine is mounted and a plurality of connecting posts disposed adjacent to edges of the top face at selected positions, such that at least one post on one pedestal module is adjacent to at least one post on an adjacent pedestal module, wherein the top face is provided with recesses surrounding the posts in which a connecting member can be seated, at least one connecting member having a plurality of openings, at least two openings being spaced apart a distance approximating a spacing between the adjacent posts of the adjacent pedestal modules, whereby openings in the connecting member can simultaneously engage adjacent connecting posts of adjacent pedestal modules such that the openings in the connecting member simultaneously engage adjacent connecting posts of adjacent pedestal modules with the connecting member seated in the recesses, and a plurality of vending machines each having a base for engaging over the connecting members.

19. The combination of claim 18 including means for locking the vending machines to the pedestal.

20. The combination of claim 18 in which upper portions of adjacent vending machines are connected by a connecting element.

* * * * *